US008818244B2

(12) United States Patent
Hirayama et al.

(10) Patent No.: US 8,818,244 B2
(45) Date of Patent: Aug. 26, 2014

(54) DEVELOPING DEVICE AND IMAGE FORMING APPARATUS

(75) Inventors: Yushi Hirayama, Kanagawa (JP); Hitoshi Ishibashi, Kanagawa (JP); Shuji Hirai, Tokyo (JP); Satoshi Kaneko, Kanagawa (JP); Hideo Muroi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 173 days.

(21) Appl. No.: 13/453,286

(22) Filed: Apr. 23, 2012

(65) Prior Publication Data

US 2013/0004207 A1 Jan. 3, 2013

(30) Foreign Application Priority Data

Jul. 1, 2011 (JP) ..... 2011-147207
Mar. 28, 2012 (JP) ..... 2012-073296

(51) Int. Cl.
*G03G 15/08* (2006.01)

(52) U.S. Cl.
CPC ..... *G03G 15/0848* (2013.01); *G03G 15/0889* (2013.01); *G03G 15/0893* (2013.01)
USPC ..... 399/254

(58) Field of Classification Search
CPC ..... G03G 15/0168; G03G 15/0147
USPC ..... 399/254
See application file for complete search history.

(56) References Cited

U.S. PATENT DOCUMENTS 5,913,098 A 6/1999 Toyama
6,757,512 B2 6/2004 Miyawaki et al.
7,139,511 B2 11/2006 Ishibashi
7,203,452 B2 4/2007 Miyawaki et al.
7,305,195 B2 12/2007 Ishibashi
7,343,126 B2 3/2008 Miyawaki et al.
7,398,026 B2 7/2008 Ishibashi
7,477,856 B2 1/2009 Yoneda et al.

(Continued)

FOREIGN PATENT DOCUMENTS

CN 101286027 A 10/2008
CN 101339392 A 1/2009

(Continued)

OTHER PUBLICATIONS

Chinese Office Action issued Nov. 6, 2013, in China Patent Application No. 201210188619.0.

*Primary Examiner* — Walter L Lindsay, Jr.
*Assistant Examiner* — Frederick Wenderoth
(74) *Attorney, Agent, or Firm* — Oblon, Spivak, McClelland, Maier & Neustadt, L.L.P.

(57) ABSTRACT

A developing device for developing an electrostatic latent image on an image bearing member including a developer bearing member opposed to the image bearing member to bear thereon a developer including a toner and a magnetic carrier; a developer containing part to contain the developer to supply the developer to the developer bearing member; an agitating or feeding member to agitate or feed the developer in the developer containing part; a magnetic permeability sensor to measure magnetic permeability of the developer to determine toner concentration of the developer; a developer feeder; a feeding member to feed the developer to the developer containing part through the developer feeder; and a driver to drive the feeding member independently of the agitating or feeding member. The magnetic permeability sensor is arranged on the developer feeder.

6 Claims, 3 Drawing Sheets

(56) References Cited

U.S. PATENT DOCUMENTS

| | | | | |
|---|---|---|---|---|
| 7,526,219 | B2 | 4/2009 | Ishibashi | |
| 7,546,046 | B2 | 6/2009 | Ishibashi | |
| 7,616,909 | B2 | 11/2009 | Kato et al. | |
| 7,693,466 | B2 | 4/2010 | Miyawaki et al. | |
| 7,773,899 | B2 | 8/2010 | Ishibashi | |
| 8,099,006 | B2 | 1/2012 | Fujimori et al. | |
| 2005/0286916 | A1 | 12/2005 | Nakazato et al. | |
| 2011/0044726 | A1* | 2/2011 | Katoh et al. | 399/254 |
| 2011/0058823 | A1 | 3/2011 | Hirai | |
| 2011/0110689 | A1 | 5/2011 | Hirayama et al. | |
| 2011/0222884 | A1* | 9/2011 | Hirayama et al. | 399/53 |
| 2011/0229171 | A1 | 9/2011 | Hirai | |
| 2011/0311279 | A1* | 12/2011 | Okazaki et al. | 399/254 |
| 2012/0092687 | A1 | 4/2012 | Hirai | |

FOREIGN PATENT DOCUMENTS

| | | |
|---|---|---|
| JP | 2003-280356 | 10/2003 |
| JP | 2003-280384 | 10/2003 |
| JP | 2003-302835 | 10/2003 |
| JP | 2005-128043 | 5/2005 |
| JP | 2005-241865 | 9/2005 |
| JP | 2006-258903 | 9/2006 |
| JP | 2008-76497 | 4/2008 |
| JP | 2011-128381 | 6/2011 |

* cited by examiner

DEVELOPING DEVICE AND IMAGE FORMING APPARATUS

CROSS-REFERENCE TO RELATED APPLICATIONS

This patent application is based on and claims priority pursuant to 35 U.S.C. §119 to Japanese Patent Applications Nos. 2011-147207 and 2012-073296, filed on Jul. 1, 2011 and Mar. 28, 2012, respectively, in the Japan Patent Office, the entire disclosure of which is hereby incorporated herein by reference.

FIELD OF THE INVENTION

The present invention relates to a developing device. In addition, the present invention also relates to an image forming apparatus using the developing device.

BACKGROUND OF THE INVENTION

Recently, a developing device using a two-component developer including a toner and a magnetic carrier is mainly used for image forming apparatuses such as copiers, printers, facsimiles and multifunction products having two or more functions of a copier function, a printer function, and a facsimile function. A developing device illustrated in FIG. 4 is an example of such a developing device.

Referring to FIG. 4, a developing device 100 includes a developing sleeve 101 serving as a developer bearing member, a first feeding screw 102 and a second feeding screw 103, which feed a two-component developer to the developing sleeve 101 while circulating the developer, and a first developer containing part 104 and a second developer containing part 105, which contain the two-component developer including a toner and a magnetic carrier. In this regard, central portions of the first and second developer containing parts 104 and 105 are separated from each other by a partition 106 provided on a casing of the developing device 100, and communication holes 107 and 108 are formed on both end portions of the first and second developer containing parts 104 and 105 to communicate the developer containing parts 104 and 105 with each other.

A drive motor 109 is provided on a shaft of the developing sleeve 101 to directly transfer a rotation driving force of the drive motor 109 to the shaft of the developing sleeve 101, thereby rotating the developing sleeve 101. An axle gear 110 provided on the shaft of the developing sleeve 101 is engaged with a first receiver gear 111 provided on one end portion of the first feeding screw 102. Since the gears 110 and 111 are engaged with each other, the rotation driving force of the drive motor 109 is transmitted to the first feeding screw 102, thereby rotating the first feeding screw 102. In addition, an intermediate gear 112 is provided on the other end portion of the first feeding screw 102 so as to be engaged with a second receiver gear 113. Since the gears 112 and 113 are engaged with each other, the rotation driving force of the drive motor 109 is transmitted to the second feeding screw 103, thereby rotating the second feeding screw 103.

The two-component developer (hereinafter referred to as a developer) contained in the second developer containing part 105 is fed from left to right in FIG. 4 by the second feeding screw 103. The developer thus fed by the second feeding screw 103 is then fed to the first developer containing part 104 through the right communication hole 107. The first feeding screw 102, which is arranged in the vicinity of the developing sleeve 101, feeds the developer in the first developer containing part 104 from right to left in FIG. 4 while feeding the developer to the developing sleeve 101. In addition, the first feeding screw 102 feeds the developer in the first developer containing part 104 from right to left in FIG. 4 while receiving the developer, which has been used for developing an electrostatic latent image on a photoreceptor drum 1, from the developing sleeve 101. The developer fed to the left end of the first developer containing part 104 by the first feeding screw 102 is returned to the second developer containing part 105 through the communication hole 108. Thus, the developer in the developing device 100 is circulated in the first and second developer containing parts 104 and 105.

The developing sleeve 101 bears thereon the developer fed by the first feeding screw 102 by means of a magnetic force of a magnet roller provided in the developing sleeve 101. An electrostatic latent image formed on the photoreceptor 1 serving as a latent image bearer is developed with the toner included in the developer on the developing sleeve 101. The developer used for development, in which the toner therein is consumed for development, is returned to the first developer containing part 104 to be mixed with the developer fed by the first feeding screw 102. The mixed developer is fed to the second developer containing part 105, and is then mixed with a toner supplied from a toner supply opening 114 to increase the toner concentration of the developer. In this case, a magnetic permeability sensor to detect the toner concentration of the developer is provided on a proper portion of the second developer containing part 105 to determine the mixing ratio of the magnetic carrier to the toner from the measured magnetic permeability. A toner supplying device supplies the toner to the second developer containing part 105 of the developing device 100 if desired so that the developer mixed with the toner has a toner concentration in the predetermined concentration range.

Among image forming apparatus using such a developing device 100, an image forming apparatus is known which has multiple print modes and changes the process linear velocity thereof when a user changes the print mode. In this regard, for example, change of the process linear velocity is performed as follows. Specifically, when a standard mode is selected from the multiple print modes using an operation part, image forming members such as the photoreceptor 1 and the developing sleeve 101 are rotated at a predetermined reference linear velocity. When an image quality oriented mode is selected, the image forming members are rotated at a linear velocity lower than the reference linear velocity. In contrast, when a print speed oriented mode is selected, the image forming members are rotated at a linear velocity higher than the reference linear velocity.

There is a proposal in which the developer feeding speed of the first developer feeding screw is controlled independently of that of the second developer feeding screw. Specifically, the developer feeding speed of the second developer feeding screw, which is rotated in synchronization with the developing roller, is controlled by controlling the rotation speed of a development motor via a second motor driver, which is performed by a controller. In addition, the developer feeding speed of the first developer feeding screw is controlled by controlling the rotation speed of a first feeding motor via a first motor driver, which is also performed by the controller.

Further, there is a proposal in which when the revolution of the first feeding screw is R1 (rps) and the revolution of the second feeding screw is R2 (rps), the output from a toner concentration sensor is periodically read in a cycle of not less than a least common of 1/R1 and 1/R2.

Furthermore, there is a proposal for an image forming apparatus having various processing speeds and performing inductance detection to detect the developer concentration. In the developing device, the concentration detection is carried out only when the linear velocity of a screw for agitating and feeding developer is a predetermined first rotating velocity.

In these image forming apparatuses, the rotation speeds of the first and second feeding screws 102 and 103 depend on the rotation speed of the developing sleeve 101. Therefore, the screws feed the developer at a speed corresponding to the selected mode. Namely, the developer feeding speed is changed depending on the modes. Therefore, even when the developer feeding speed is changed due to change of the mode, the speed at which the developing sleeve 101 uses the developer is also changed depending on the mode, and a proper amount of developer is generally supplied to the developing sleeve 101.

However, as a result of an experiment of the present inventors, there is a case in which when the feeding speed of a developer is changed, the output from the magnetic permeability sensor is changed even though the toner concentration of the developer is not changed. The result of the experiment is illustrated in FIG. 5. FIG. 5 is a graph showing a relation between the revolution of the feeding screw 102 and the output from the magnetic permeability sensor.

In the experiment, the toner concentration of the developer is controlled to 7% by weight. It can be understood from FIG. 5 that when the revolution of the first feeding screw 102 changes, the output from the magnetic permeability sensor changes.

It is also confirmed from this experiment that since the output from the magnetic permeability sensor changes even when the toner concentration is not changed, the toner concentration determining operation has a large margin of error.

When the toner concentration determining operation has a large margin of error, the toner concentration controlling operation is performed based on the incorrect toner concentration, which is largely different from the correct toner concentration, a problem in that the developer has too high or too low toner concentration is caused.

In attempting to solve the problem, there is a proposal in which the developer feeding direction and speed at the magnetic permeability detecting part are set so as to be constant independently of the image forming modes (such as print speed oriented mode, image quality oriented mode, and the like) by maintaining the revolution of the feeding screw feeding the developer at the magnetic permeability detecting part so as to be constant independently of the revolution of the developing roller.

By using this technique, change of the output from a magnetic permeability sensor due to change of the print modes can be reduced. However, the technique has a drawback such that at a low image forming speed, the developer is not well-balanced in the developer container, thereby changing the developer drawing conditions of the developing roller.

For these reasons, the inventors recognized that there is a need for a developing device in which the toner concentration of the developer can be determined by a magnetic permeability sensor without affected by change of the process linear velocity of the developing device and in which the developer is fed while well balanced.

BRIEF SUMMARY OF THE INVENTION

As an aspect of the present invention, a developing device for developing an electrostatic latent image on an image bearing member is provided which includes a developer bearing member located so as to be opposed to the image bearing member to bear thereon a developer including a toner and a magnetic carrier, a developer containing part to contain the developer to supply the developer to the developer bearing member, an agitating or feeding member to agitate or feed the developer in the developer containing part, and a magnetic permeability sensor to measure magnetic permeability of the developer to determine toner concentration of the developer. The developing device further includes a developer feeder, a feeding member located in the developer feeder to feed the developer to the developer containing part through the developer feeder, and a driver to drive the feeding member. The magnetic permeability sensor is provided on the developer feeder, and the feeding member is driven independently of the agitating or feeding member.

As another aspect of the present invention, an image forming apparatus is provided which includes an image bearing member to bear an electrostatic latent image thereon, and the above-mentioned developing device to develop the electrostatic latent image with the developer to form a toner image on the image bearing member.

The aforementioned and other aspects, features and advantages will become apparent upon consideration of the following description of the preferred embodiments taken in conjunction with the accompanying drawings.

DETAILED DESCRIPTION OF THE INVENTION

The present invention will be described by reference to drawings.

Figure 1:
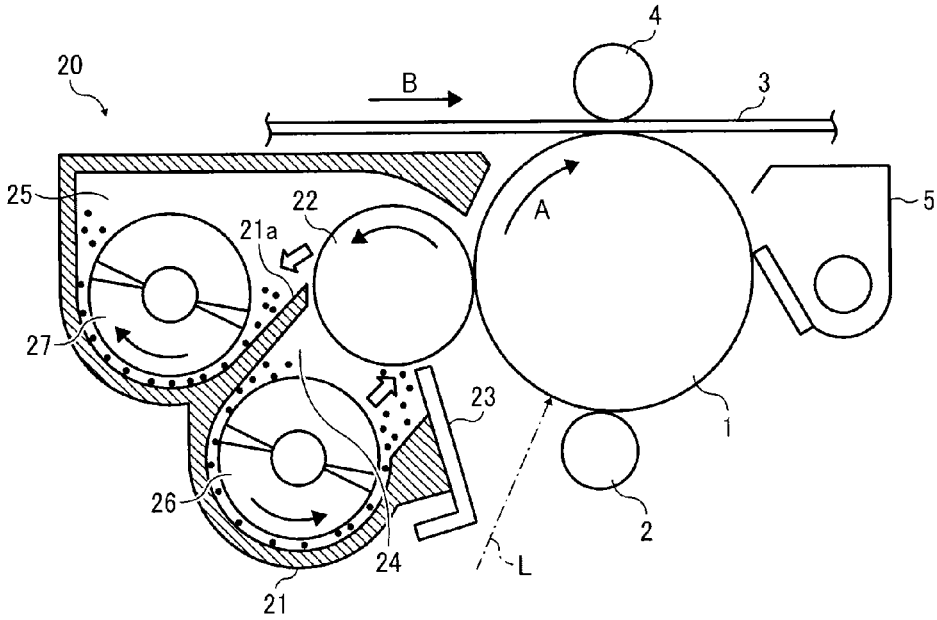
FIG. 1 is a schematic view illustrating an image forming section of an example of the image forming apparatus of the present invention.

FIG. 1 is a schematic view illustrating an image forming section of an example of the image forming apparatus of the present invention. The image forming apparatus illustrated in FIG. 1 has a photoreceptor drum 1, which serves as an image bearing member and which is driven to rotate in a direction indicated by an arrow A, and a charger including a charging roller 2, to which a voltage is applied to charge the photoreceptor drum 1 so that the photoreceptor drum has a predetermined potential with a predetermined polarity. In addition, the image forming apparatus has an optical image writing device to irradiate the charged photoreceptor drum 1 with an optically modulated laser beam L to form an electrostatic latent image on the photoreceptor drum 1. A developing device 20 develops the electrostatic latent image on the photoreceptor drum 1 with a developer including a toner and a magnetic carrier to form a toner image on the photoreceptor drum 1. The developing device 20 will be described later in detail.

The image forming apparatus further includes an intermediate transfer belt 3, which is located above the photoreceptor drum 1 and which is rotated in a direction indicated by an arrow B, and a primary transfer roller 4, which is arranged so as to be opposed to the photoreceptor drum 1 with the intermediate transfer belt 3 therebetween. A transfer bias voltage is applied to the primary transfer roller 4 to transfer the toner image on the photoreceptor drum 1 to the intermediate transfer belt 3. The image forming apparatus further includes a cleaner 5 to remove residual toner particles remaining on the surface of the photoreceptor drum 1 even after the primary transfer operation, and a discharger to remove residual charges remaining on the surface of the photoreceptor drum 1 even after the primary transfer operation is performed, so that the photoreceptor drum 1 is ready for the next image forming operation. The image forming apparatus is a color image forming apparatus in which four image forming sections, which have the same configuration as that of the image forming section illustrated in FIG. 1 and which use different color toners such as yellow, magenta, cyan and black toners, are arranged side by side.

The developing device 20 includes a case 21 in which a developer including a toner and a particulate magnetic carrier at a weight ratio (toner/carrier) of 7/93 is contained, a developing roller 22, which serves as a developer bearing member and which is arranged so as to be opposed to the photoreceptor drum 1 at an opening of the case 21 while rotatably supported by the case 21. The developing roller 22 includes a rotatable developing sleeve, and a fixed magnetic roller, which is arranged in the developing sleeve. The toner is preferably a toner prepared by a polymerization method.

A doctor blade 23, which serves as a developer regulating member and which is supported by the case 21, is arranged below the developing roller 22 so as to be close to the developing roller 22 to control the amount of the developer present on the surface of the developing roller 22. The developing device 20 also includes a developer feeding chamber 24, which serves as a developer containing part and which is located obliquely below the developing roller 22 so as to be opposed to the developing roller, and a developer agitating chamber 25, which is located in the horizontal direction from the developing roller 22 and which is located over the developer feeding chamber 24. A feeding screw 26 (hereinafter referred to as a second feeding screw) serving as an agitating or feeding member (a second feeding member) to agitate or feed the developer is provided in the developer feeding chamber 24, which is located on an upstream side from the developing roller 22 relative to the developer feeding direction, and another feeding screw 27 (hereinafter referred to as a third feeding screw) also serving as an agitating or feeding member (a third feeding member) to agitate or feed the developer is provided in the developer agitating chamber 25, which is located on a downstream side from the developing roller 22 relative to the developer feeding direction. Reference numeral 21*a* denotes a partition separating the developer feeding chamber 24 from the developer agitating chamber 25.

Figure 2:
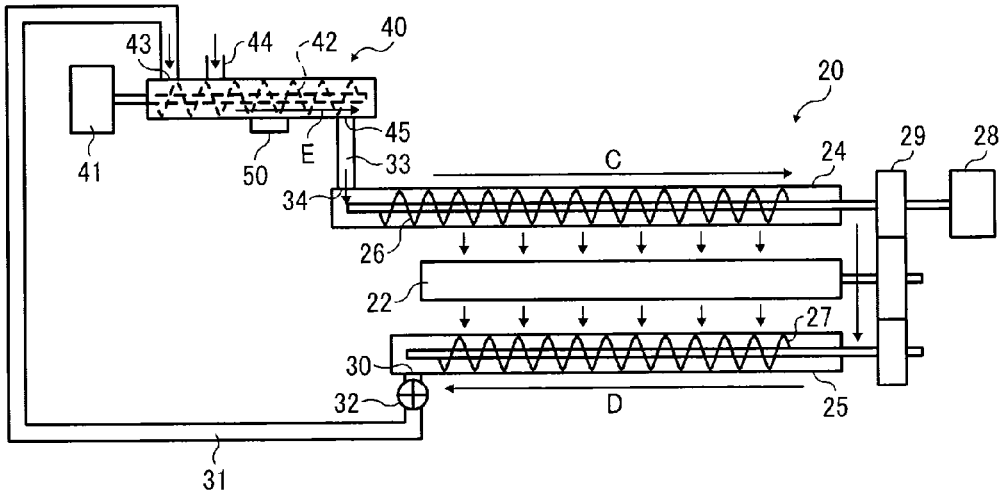
FIG. 2 is a development view illustrating an example of the developing device of the present invention for use in the image forming section illustrated in FIG. 1.

FIG. 2 is a development view illustrating the developing device 20. As illustrated in FIGS. 1 and 2, the second and third feeding screws 26 and 27 are arranged such that the shaft lines of the second and third feeding screws 26 and 27 are parallel to the shaft line of the developing roller 22. The developing roller 22 and the second and third feeding screws 26 and 27 are connected with a driving motor 28 serving as a first driver via a drive transmitter 29 including plural gears so as to be driven such that the developing roller 22 and the second feeding screw 26 are rotated counterclockwise in FIG. 1, and the third feeding screw 27 is rotated clockwise in FIG. 1. When the second feeding screw 26 is rotated, the developer in the developer feeding chamber 24 is fed in a direction indicated by an arrow C in FIG. 2, and when the third feeding screw 27 is rotated, the developer in the developer agitating chamber 25 is fed in a direction indicated by an arrow D in FIG. 2.

As illustrated in FIG. 2, a developer circulation entrance 30 is provided on a downstream side of the developer agitating chamber 25 relative to the developer feeding direction D. The developer circulation entrance 30 is connected with a junction feeder 40 serving as a developer feeder mentioned later via a first circulation pipe 31. In this example of the developing device, an air pump 32 is provided on the first circulation pipe 31 to feed the developer from the developer agitating chamber 25 to the junction feeder 40. In this regard, not only an air pump but also a screw or a powder pump can be used for feeding the developer. In addition, it is possible to feed the developer by gravitation if condition permits.

A feeding screw 42 (hereinafter referred to as a first feeding screw), which serves as a first feeding member and which is rotated by a drive motor 41 serving as an independent second driver, is provided in the junction feeder 40 to feed the developer in the junction feeder 40 in a direction indicated by an arrow E in FIG. 2. The circulation pipe 31 is connected with a feeder entrance 43 provided on an upstream side of the junction feeder 40 relative to the developer feeding direction E, and a supplementary developer supplying part 44, to which a supplementary developer is supplied from a developer container (not shown), is provided in the vicinity of the feeder entrance 43 so as to be connected with the junction feeder 40.

In addition, a feeder exit 45 is provided in the junction feeder 40 so as to be located downstream from the feeder entrance 43 and the supplementary developer supplying part 44, and is connected with a developer feed entrance 34 via a second circulation pipe 33. A magnetic permeability sensor 50 is provided on a bottom portion of the junction feeder 40 between the supplementary developer supplying part 44 and the circulation exit 45.

Next, flow of the developer in the developing device 20 will be described. Referring to FIG. 2, the developer supplied from the developer feed entrance 34 located on an upstream side of the developer feeding chamber 24 is fed by the second feeding screw 26 in the direction C while drawn to the entire surface of the developing roller 22 by a magnetic pole of the magnet roller fixed inside the developing roller 22. The developer thus drawn to the developing roller 22 is regulated by the doctor blade 23, thereby forming a developer layer on the developing roller 22. The developer, which is not used for forming the developer layer because of being scraped off the developing roller 22 by the doctor blade 23, is returned to the developer agitating chamber 25 from an opening of the developer feeding chamber 24 located on the downstream side of the developer feeding chamber 24. The developer layer, which is formed on the developing roller 22 and which passes through a development region in which part of the toner included in the developer layer is used for developing en electrostatic latent image on the photoreceptor drum 1, is released from the developing sleeve of the developing roller 22 by a developer releasing magnetic pole of the magnet roller in the developing roller 22, and the developer is then returned to the developer agitating chamber 25 located over the developer feeding chamber 24.

Thus, the developer fed in the direction C in the developer feeding chamber 24 and the developer returned from substantially the entire surface of the developing roller 22 by the developer releasing magnetic pole are fed to the upstream side of the developer agitating chamber 25 relative to the direction D. The developer mixture is fed in the direction D by the third feeding screw 27 and reaches the developer circulation entrance 30. The developer reaching the developer circulation entrance 30 is fed by the air pump 32 to the junction feeder 40 through the first circulation pipe 31. The junction feeder 40 receives the developer fed from the developer agitating chamber 25 and the supplementary developer (toner) supplied from the supplementary developer supplying part 44 to compensate for loss of the toner in the developing operation. After the developer mixture is fed rightward (in FIG. 2) while agitated by the first feeding screw 42, the developer mixture is fed from the feeder exit 45 to the upstream side of the developer feeding chamber 24 through the second circulation pipe 33.

The magnetic permeability sensor 50 provided at a bottom portion of the junction feeder 40 outputs a magnetic permeability signal corresponding to the magnetic permeability of the developer to a controller. It is known that the magnetic permeability of a developer including a magnetic carrier and a nonmagnetic toner correlates with the toner concentration of the developer. The controller determines the toner concentration of the developer in the developing device 20 based on the magnetic permeability signal sent from the magnetic permeability sensor 50, and controls rotation of the developing sleeve of the developing roller 22 based on the signal (toner concentration). Specifically, when the toner concentration is lower than a reference concentration, the controller drives a toner supplying device to supply the toner to the junction feeder 40 through the developer supplying part 44. Thus, the toner concentration is recovered. In this regard, the developer supplied to the junction feeder 40 is the toner or a mixture of the carrier and the toner (supplementary developer).

In a printer equipped with the developing device 20 having the above-mentioned configuration, one of three print modes, e.g., a standard mode, an image quality oriented mode and a print speed oriented mode, is selected by a user using an operating portion. When the standard mode is selected, the process linear velocity of the printer is set to a reference linear velocity. In this regard, the process linear velocity means the linear velocity of image forming members such as the photoreceptor drum 1, the developing device 20, the transfer roller 4, and a heating roller and a pressure roller of a fixing device of the printer. When the image quality oriented mode is selected, the process linear velocity of the printer is set to a linear velocity lower than the reference linear velocity. In this mode, the printer produces prints having higher image qualities than in the standard mode. In contrast, when the print speed oriented mode is selected, the process linear velocity of the printer is set to a linear velocity higher than the reference linear velocity. In this mode, the printer produces prints at a higher print speed than in the standard mode.

In the developing device 20 of such a printer, which can change the process linear velocity, the linear velocity of the developing roller 22 (developing sleeve), and the second and third feeding screws 26 and 27 is also changed. In conventional developing devices, a magnetic permeability sensor is typically arranged at a bottom portion of a chamber having a feeding screw (such as the developer agitating chamber 25 having the third feeding screw 27 therein), and therefore outputs from the magnetic permeability sensor are changed when the velocity (revolution) of the feeding screw is changed, resulting in deterioration of the detection precision. Therefore, it is proposed that the feeding screw is driven independently of the developing roller (sleeve) and the other feeding screw (such as the second feeding screw 26) to reduce the change of the developer feeding speed of the feeding screw, thereby preventing deterioration of the detection precision. However, as mentioned above, the technique has a drawback in that when the developer feeding speed of the feeding screw is different from those of the developing roller and the other feeding screw, the developer is not well-balanced in the developer container, thereby changing the amount of the developer drawing to the developing roller. Particularly, in a vertical agitation type developing device such as the developing device 20 mentioned above, in which the developer on the developing roller 22 is returned to the developer agitating chamber 25 having the third feeding screw 27 therein, the developer cannot be smoothly flown in the developing device due to difference in velocity between the third feeding screw 27, and the developing roller 22 and the second feeding screw 26, thereby causing various problems including the above-mentioned problem.

In contrast, in the developing device 20 of the present invention, a magnetic permeability sensor 50, which outputs a magnetic permeability signal corresponding to the magnetic permeability of the developer, is provided at a bottom portion of the junction feeder 40, which has the first feeding screw 42 driven by the driving motor 41, which is independent of a driver of the developing roller 22, etc. Therefore, even when the print mode is changed, the developer in the junction feeder 40 can be fed at a constant speed or a speed in a narrow speed range. Accordingly, the magnetic permeability sensor 50 can detects the magnetic permeability of the developer with precision (i.e., at a small error rate) even when the image forming speed (developing speed) is changed due to change of the print mode.

When the print mode is changed in the developing device 20 illustrated in FIG. 2 and thereby the first and second feeding screws are rotated at a higher velocity than the first feeding screw 42, a problem such that the developer cannot be satisfactorily supplied to the developer feeding chamber 24 and the developer in the developer agitating chamber 25 cannot be satisfactorily fed to the junction feeder 40 because the developer feeding speed in the junction feeder is relatively slow may be caused if the velocity difference condition is continued for a long period of time.

Figure 3:
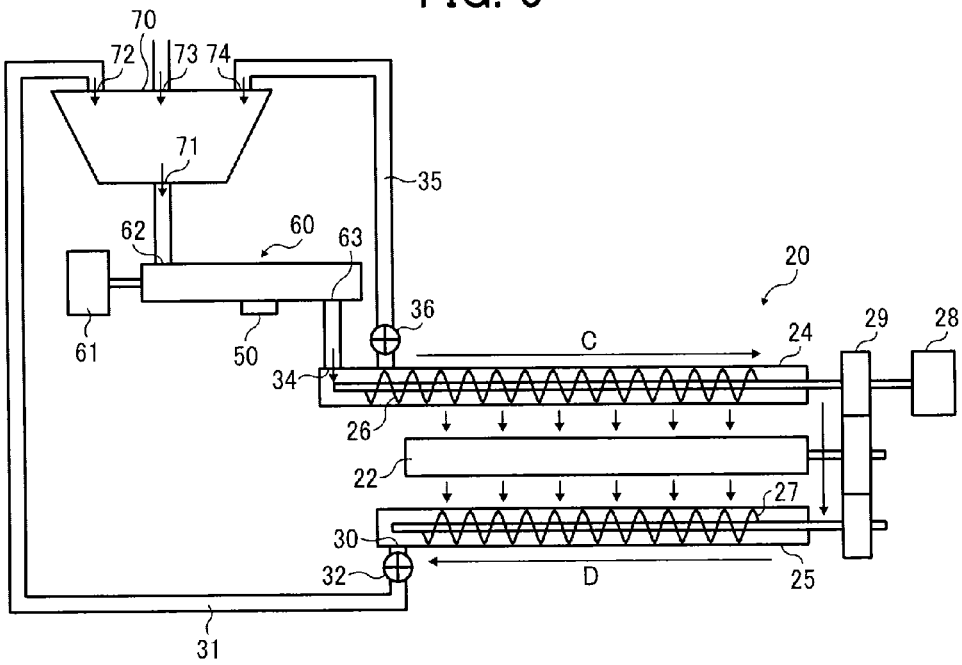
FIG. 3 is a development view illustrating another example of the developing device of the present invention for use in the image forming section illustrated in FIG. 1.
Figure 4:
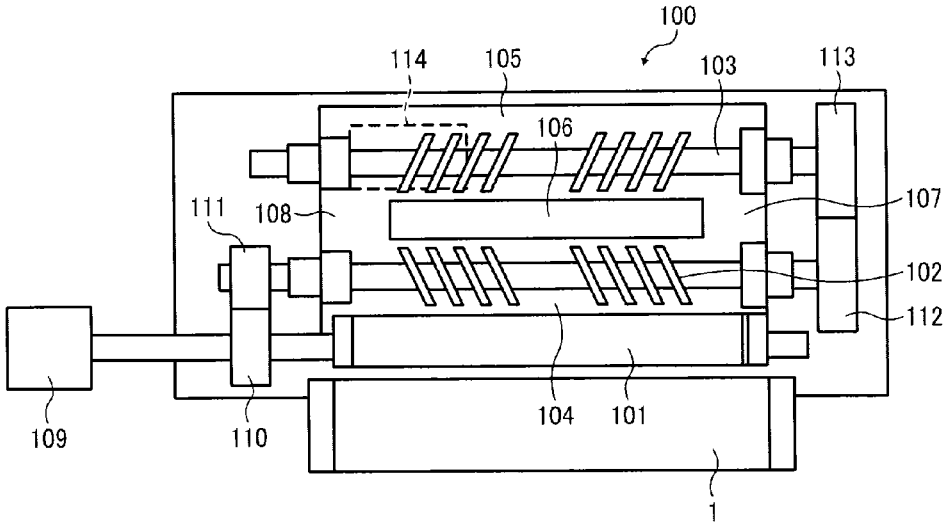
FIG. 4 RELATED ART
FIG. 4 is a development view illustrating a conventional developing device.
Figure 5:
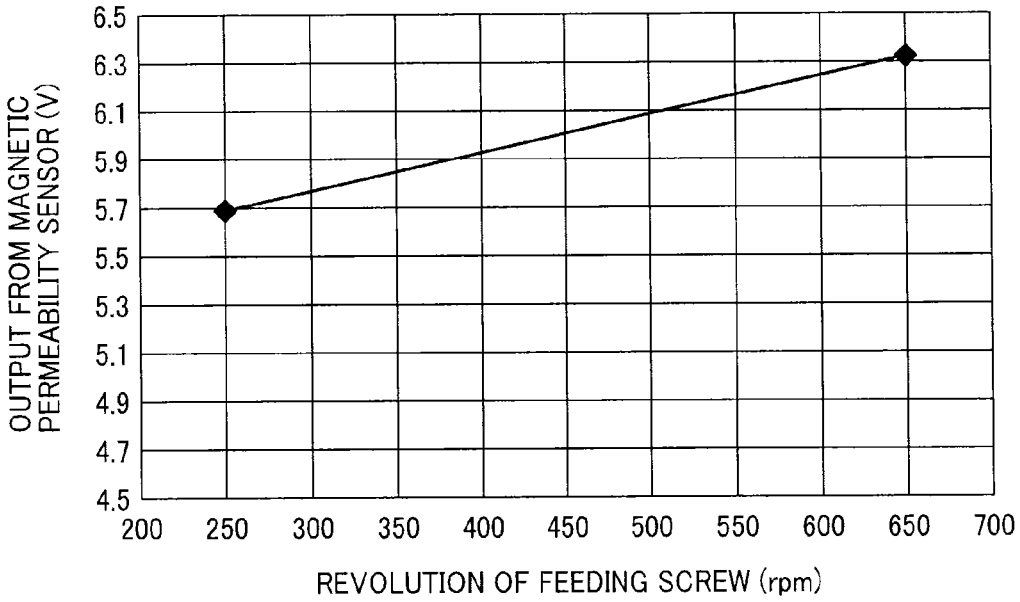
FIG. 5 is a graph illustrating a relation between the revolution of a feeding screw to feed a developer and the output from a magnetic permeability sensor to measure the magnetic permeability of the developer.

In order to prevent occurrence of such a problem, the developing device of the present invention can have a developer storage. Specifically, in another example of the developing device of the present invention, which is illustrated in FIG. 3, a developer storage 70 to store the developer fed from the developer agitating chamber 25, the supplementary developer (or toner) supplied from a developer container through a supply entrance 73, and the developer overflowing on an upstream side of the developer feeding chamber 24, is provided. Specifically, the developer fed from the developer agitating chamber 25 is fed to the developer storage 70 through an end 72 of the first circulation pipe 31, the supplementary developer is supplied to the developer storage 70 through the supply entrance 73, and the developer overflowing the developer feeding chamber 24 is fed to the developer storage 70 through a return entrance 74. The developer stored in the developer storage 70 is discharged from a developer exit 71 to be supplied to a feeder 60 serving as a developer feeder through a feeder entrance 62. Similarly to the junction feeder 40, the feeder 60 has a feeding screw driven by a driving motor 61, which is an independent driver, and the magnetic permeability sensor 50, which is provided on a bottom portion of the feeder 60 and which outputs a magnetic permeability signal corresponding to the magnetic permeability of the developer.

In this example, the developer feeding speed of the feeding screw of the feeder 60 is set to the highest speed so as to be able to correspond to the print speed oriented mode in which the process linear velocity is the highest. Even when the standard mode or the image quality oriented mode is selected as the print mode, in which the print speed is slower than in the print speed oriented mode, the developer feeding speed is not changed. In this case, the developer feeding speed is not changed in the feeder 60, and therefore the detection precision of the magnetic permeability sensor 50 does not deteriorate. When the standard mode or the image quality oriented mode is selected as the print mode, an excessive amount of developer is fed to the developer feeding chamber 24. In this case, excessive of the developer, which overflows the developer feeding chamber 24, is returned by an air pump 36 serving as a developer returning member to the developer storage 70 via a return pipe 35. Therefore, the developer is fed in the developing device 20 while well-balanced. In this regard, it is possible to substitute a screw or a powder pump for the air pump 36 similarly to the air pump 32. In addition, it is possible to feed the developer by gravitation if condition permits.

Thus, this example can produce an effect such that fluctuation of outputs from the magnetic permeability sensor 50 can be decreased while producing an effect such that the developer in the developing device 20 is fed while well balanced.

Hereinbefore, several examples of the developing device of the present invention have been described. However, the present invention is not limited thereto, and additional modifications and variations of the present invention are possible in light of the above teachings. For example, although the above-mentioned developing device is a vertical agitation type developing device, the present invention can also be applied to a circulation developing device in which a developer is circulated between a first screw and a second screw while the developer fed by the first screw is supplied to a developing roller, and the developer on the developing roller, which has been used for development, is returned to the chamber in which the first screw is arranged.

In addition, although a feeding screw is exemplified as the agitating or feeding member, the agitating or feeding member is not limited thereto. For example, a feeding coil can also be used as the agitating or feeding member. Even when an elliptic plate or a paddle, which is an agitating member having no feeding function, is used instead of the agitating or feeding member, fluctuation of outputs of the magnetic permeability sensor is caused. Therefore, the present invention, in which only the developer feeder, on which a magnetic permeability sensor is provided, is independently driven so as to have a constant linear velocity, can also be applied to such an agitating member.

Additional modifications and variations of the present invention are possible in light of the above teachings. It is therefore to be understood that within the scope of the appended claims the invention may be practiced other than as specifically described herein.

What is claimed is:

1. A developing device for developing an electrostatic latent image on an image bearing member, comprising:

a developer bearing member which is opposed to the image bearing member and which bears thereon a developer including a toner and a magnetic carrier while feeding the developer to develop the electrostatic latent image with the developer;

a developer containing part to contain the developer to supply the developer to the developer bearing member;

an agitating or feeding member to agitate or feed the developer in the developer containing part;

a developer feeder;

a toner feeder that feeds toner to the developer in the developer feeder;

a first feeding member located in the developer feeder to feed the developer, in a developer feeding direction within the developer feeder, to the developer containing part a driver to drive the first feeding member independently of the agitating or feeding member; and a magnetic permeability sensor located on the developer feeder at a location below the first feeding member and downstream of the toner feeder in the developer feeding direction, to measure magnetic permeability of the developer fed through the developer feeder.

2. The developing device according to claim 1, wherein the developer containing part includes:

a developer feeding chamber; and a developer agitating chamber, and the agitating or feeding member includes:

a second feeding member located in the developer feeding chamber to feed the developer in the developer feeding chamber; and a third feeding member located in the developer agitating chamber to agitate the developer in the developer agitating chamber, and wherein the developer is fed in order of the developer feeding chamber, the developer bearing member, the developer agitating chamber, the developer feeder, and the developer feeding chamber.

3. The developing device according to claim 2, wherein the developer containing part further includes:

a developer returning member to return the developer overflowing the developer feeding chamber of the developer containing part to the developer feeder when an excessive amount of developer is fed to the developer feeding chamber from the developer feeder.

4. The developing device according to claim 3, further comprising:

a developer storage to receive the developer fed from the developer feeding chamber, the developer fed from the developer agitating chamber, and a supplementary developer supplied to the developing device, while feeding a mixture of the developer fed from the developer feeding chamber, the developer fed from the developer agitating chamber, and the supplementary developer to the developer feeder.

5. The developing device according to claim 1, wherein the developing device is capable of changing a process linear velocity, and at least a developer feeding speed of the developer bearing member and a developer feeding speed of the agitating or feeding member are changeable depending on the process linear velocity, and wherein the first feeding member is driven at substantially a constant linear velocity even when the process linear velocity of the developing device is changed and thereby the developer feeding speed of the developer bearing member and the developer feeding speed of the agitating or feeding member are changed.

6. An image forming apparatus comprising:

an image bearing member to bear an electrostatic latent image thereon; and the developing device according to claim 1 to develop the electrostatic latent image with the developer to form a toner image on the image bearing member.

* * * * *